US005941457A

United States Patent [19]

Nakazono et al.

[11] Patent Number: 5,941,457

[45] Date of Patent: Aug. 24, 1999

[54] ROTARY ATOMIZING TYPE OF PAINTING APPARATUS

[75] Inventors: Daisuke Nakazono; Shiyuuji Minoura, both of Saitama-ken, Japan

[73] Assignee: Honda Giken Kogyo Kabushiki Kaisha, Tokyo, Japan

[21] Appl. No.: 09/129,097

[22] Filed: Aug. 5, 1998

[30] Foreign Application Priority Data

Aug. 25, 1997 [JP] Japan ..... 9-228392

[51] Int. Cl.[6] ..... B05B 3/10

[52] U.S. Cl. ..... 239/223; 239/290

[58] Field of Search ..... 239/223, 224, 239/290, 700, 703

[56] References Cited

U.S. PATENT DOCUMENTS 4,572,437 2/1986 Huber et al. ..... 239/703

FOREIGN PATENT DOCUMENTS 0 243 043 A2 10/1987 European Pat. Off. .

*Primary Examiner*—Andres Kashnikow
*Assistant Examiner*—Jorge Bocanegra
*Attorney, Agent, or Firm*—Armstrong, Westerman, Hattori, McLeland & Naughton

[57] ABSTRACT

A rotary atomizing type of painting apparatus is made up of a rotary atomizing head and a shaping air ring disposed to enclose a base portion of the rotary atomizing head such that shaping air is blown out of a jet nozzle formed in the shaping air ring toward a front end outer periphery of the rotary atomizing head. The shaping air ring is provided with a cylindrical member which partitions an air-flowing space in which the shaping air blown out of the jet nozzle flows and an outer space which is outside in the centrifugal direction of the rotary atomizing head relative to the air-flowing space.

2 Claims, 6 Drawing Sheets

TIME UNTIL SPITTING OCCURS

ROTARY ATOMIZING TYPE OF PAINTING APPARATUS

BACKGROUND OF THE INVENTION

1. Field of the Invention

The present invention relates to a rotary atomizing type of painting apparatus having a rotary atomizing head.

2. Description of the Related Art

The rotary atomizing type of painting apparatus is provided, as shown in FIG. 6, with: a rotary atomizing head 12 which projects or protrudes forward from a front opening of a casing 11 which constitutes an apparatus main body; and a shaping air ring 13 which is mounted on the casing 11 so as to enclose a base portion of the rotary atomizing head 12. By the shaping air which jets or blows outward from a jet nozzle 13*a* which is formed in the shaping ring 13, the atomized paint which is discharged centrifugally outward from the rotary atomizing head 12 is formulated or shaped into a predetermined painting pattern for further blowing or travelling toward an object to be painted.

When the shaping air is blown out of the jet nozzle 13*a*, a negative pressure occurs in a portion where the blown shaping air flows. As a result, the surrounding air in which foreign matters such as paint mist, or the like, are held in suspension is drawn or pulled by the shaping air and gets mixed into the shaping air. The mixed paint mist, or the like, gets adhered to the outer periphery 12*a* of the rotary atomizing head 12 and, as a consequence, the outer peripheral surface 12*a* of the rotary atomizing head 12 will be stained. A paint film will thus be formed by the accumulation of this stain. If the paint film is peeled off to thereafter adhere to the surface of the object to be painted, it will result in a poor painting quality. In order to prevent the occurrence of poor painting quality, maintenance such as cleaning by washing, or the like, is performed to the rotary atomizing head. However, if the rotary atomizing head is heavily stained, the maintenance must be performed frequently, with the result that the productivity is lowered.

In view of the above problem, the present invention has an object of providing a rotary atomizing type of painting apparatus in which the outer peripheral surface of the rotary atomizing head gets hardly stained.

SUMMARY OF THE INVENTION

In order to attain the above and other objects, the present invention is a rotary atomizing type of painting apparatus comprising: a rotary atomizing head; and a shaping air ring disposed to enclose a base portion of the rotary atomizing head such that shaping air is blown out of a jet nozzle formed in the shaping air ring toward a front end outer periphery of the rotary atomizing head; characterized in that the shaping air ring is provided with a cylindrical member which partitions an air-flowing space in which the shaping air blown out of the jet nozzle flows and an outer space which is outside in a centrifugal direction of the rotary atomizing head relative to the air-flowing space.

In the conventional apparatus, the dust, paint, or the like, which is held in suspension in the surrounding air gets mixed into the blown out shaping air from the time right after the shaping air is blown out. On the contrary, according to the present invention, by providing the cylindrical member to partition the air-flowing space in which the shaping air blown out of the jet nozzle flows and the outer space which is outside in the centrifugal direction of the rotary atomizing head relative to the air-flowing space, the position in which the shaping air and the air on the outside of the shaping air come into contact with each other is moved forward. As a result, the amount of dust to get mixed into the shaping air until the time when the shaping air passes over the front end periphery of the rotary atomizing head decreases. The outer periphery of the rotary atomizing head is therefore less likely to be stained.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
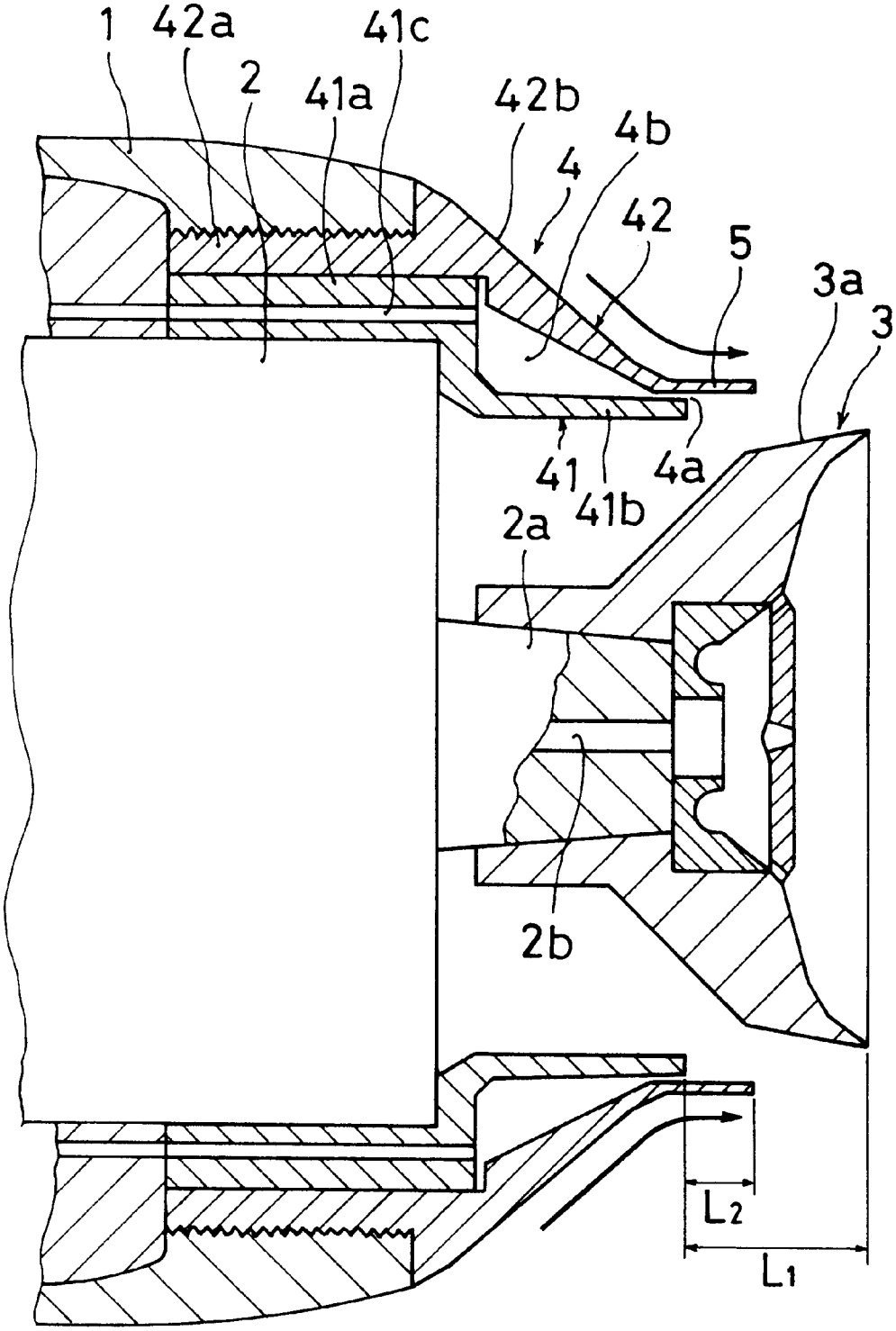
FIG. 1 is a sectional view of one embodiment of an apparatus main body of the rotary atomizing type of painting apparatus according to the present invention.

FIG. 1 shows a front end portion of a main body of a rotary atomizing type of painting apparatus. Reference numeral 1 denotes a casing of the painting apparatus main body in which an air turbine 2, a high-voltage generator (not illustrated), or the like, are contained. At a front end of a rotary shaft 2*a* of the air turbine 2, there is attached a bell-shaped rotary atomizing head 3. The rotary atomizing head 3 is supplied with a paint through an axial hole 2*b* in the rotary shaft 2*a*.

In a front opening portion of the casing 1, there is mounted a shaping air ring 4 which blows shaping air outward toward a front end periphery of the rotary atomizing head 3, in such a manner that the shaping air ring 4 encloses a base portion of the rotary atomizing head 3. The shaping air ring 4 is made up of an inner ring member 41 which constitutes an inner portion thereof and an outer ring member 42 which is disposed outside thereof. The inner ring member 41 is provided with a large-diameter portion 41*a* on a rear end side, and a small-diameter portion 41*b* which lies on a front side of the large-diameter portion 41*a*. The outer ring member 42 is provided with a large-diameter portion 42*a* which contacts, from an outer side, the large-diameter portion 41*a* of the inner ring member 41, and a tapered portion 42*b* which inclines inward from the front end of the large-diameter portion 42*a* towards the front end portion of the small-diameter portion 41*b* of the inner ring member 41.

At the front end portion of the shaping air ring 4 there is formed a jet nozzle 4*a* which is constituted by an annular clearance between the inner ring member 41 and the outer ring member 42. Between the small-diameter portion 41*b* of the inner ring member 41 and the tapered portion 42*b* of the outer ring member 42, there is formed an annular chamber 4*b* which is in communication with the jet nozzle 4*a* and which is approximately triangular in longitudinal cross section. In addition, in the large-diameter portion 41*a* of the inner ring member 41, there is formed an axially extending air supply passage 41*c* which opens into a stepped portion between the large-diameter portion 41*a* of the inner ring member 41 and the small-diameter portion 41*b* thereof. The air supply passage 41*c* is in communication with the chamber 4*b*. Therefore, when the shaping air is supplied from the air supply passage 41*c* to the chamber 4*b*, the shaping air is blown out toward the front end outer periphery of the rotary atomizing head 3. The atomized paint blown centrifugally outward from the rotary atomizing head 3 is thus formulated into a predetermined painting pattern.

When the shaping air is blown from the jet nozzle 4*a*, there occurs a negative pressure in the space in which the shaping air flows. As a result, the surrounding air in which dust and paint are held in suspension is pulled or drawn into the shaping air for subsequent mixing therewith. The dust, or the like, which has been mixed stains the outer peripheral surface 3*a* of the rotary atomizing head 3. As a solution, there is integrally formed, at a front end of the outer ring member 42 of the shaping air ring 4, a cylindrical member 5 which extends forward. In this arrangement, an air-flowing space in which the shaping air blown from the jet nozzle 4*a* flows and an outer space which is outside in the centrifugal direction of the rotary atomizing head 3 relative to the air-flowing space are separated from each other. In this arrangement, the position in which the shaping air and the air on an outer side thereof come into contact with each other moves far ahead and, as a consequence, the amount of dust, or the like, which gets mixed into the shaping air becomes smaller in amount. Therefore, the outer peripheral surface 3*a* of the rotary atomizing head 3 becomes less stained. Further, since the cylindrical body 5 is formed integrally with the outer ring member 42, the number of constituting parts does not increase, with the result that the assembly work becomes neither complicated nor troublesome.

Figure 2:
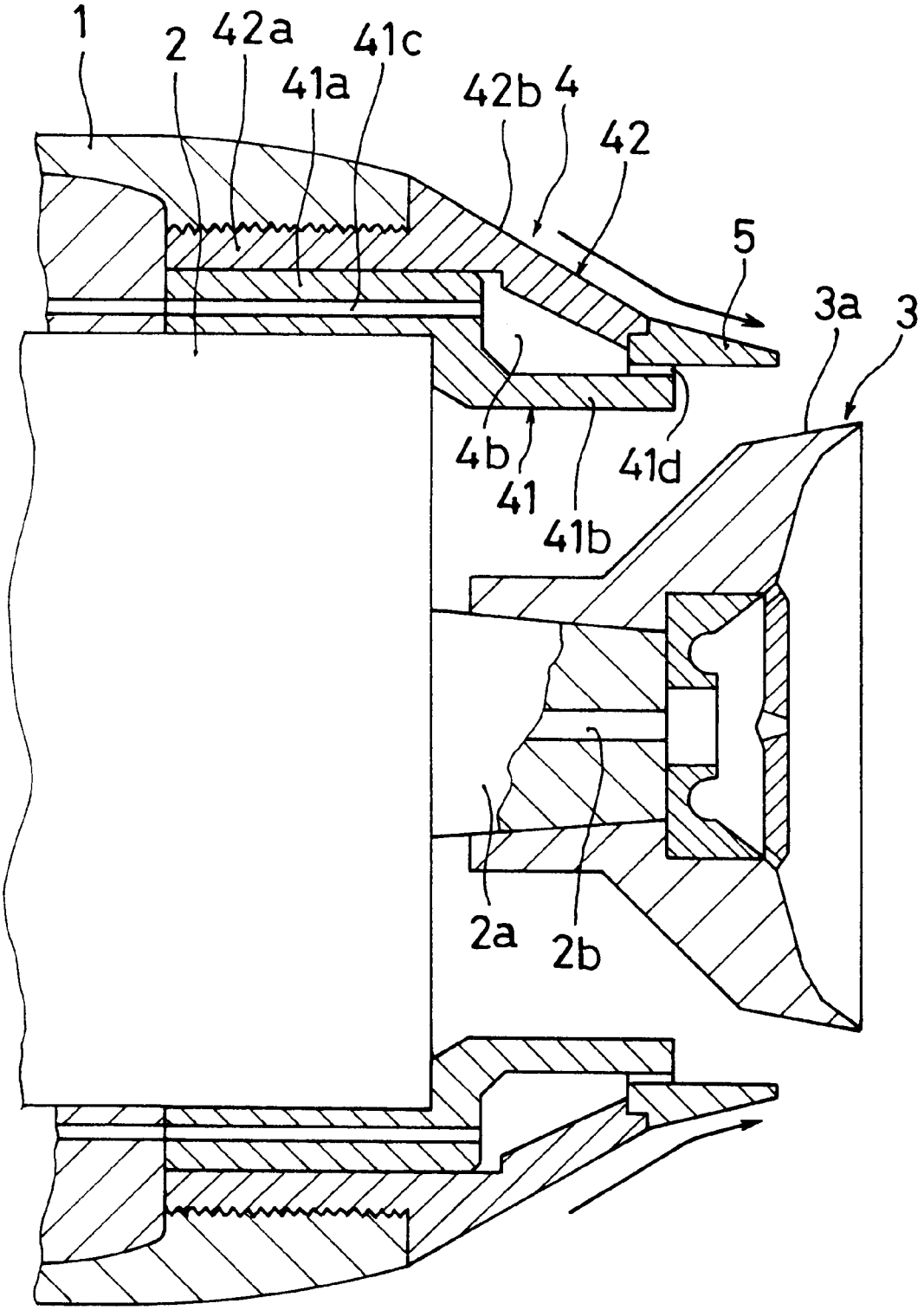
FIG. 2 is a sectional view of another embodiment of the apparatus main body of the present invention.
Figure 3:
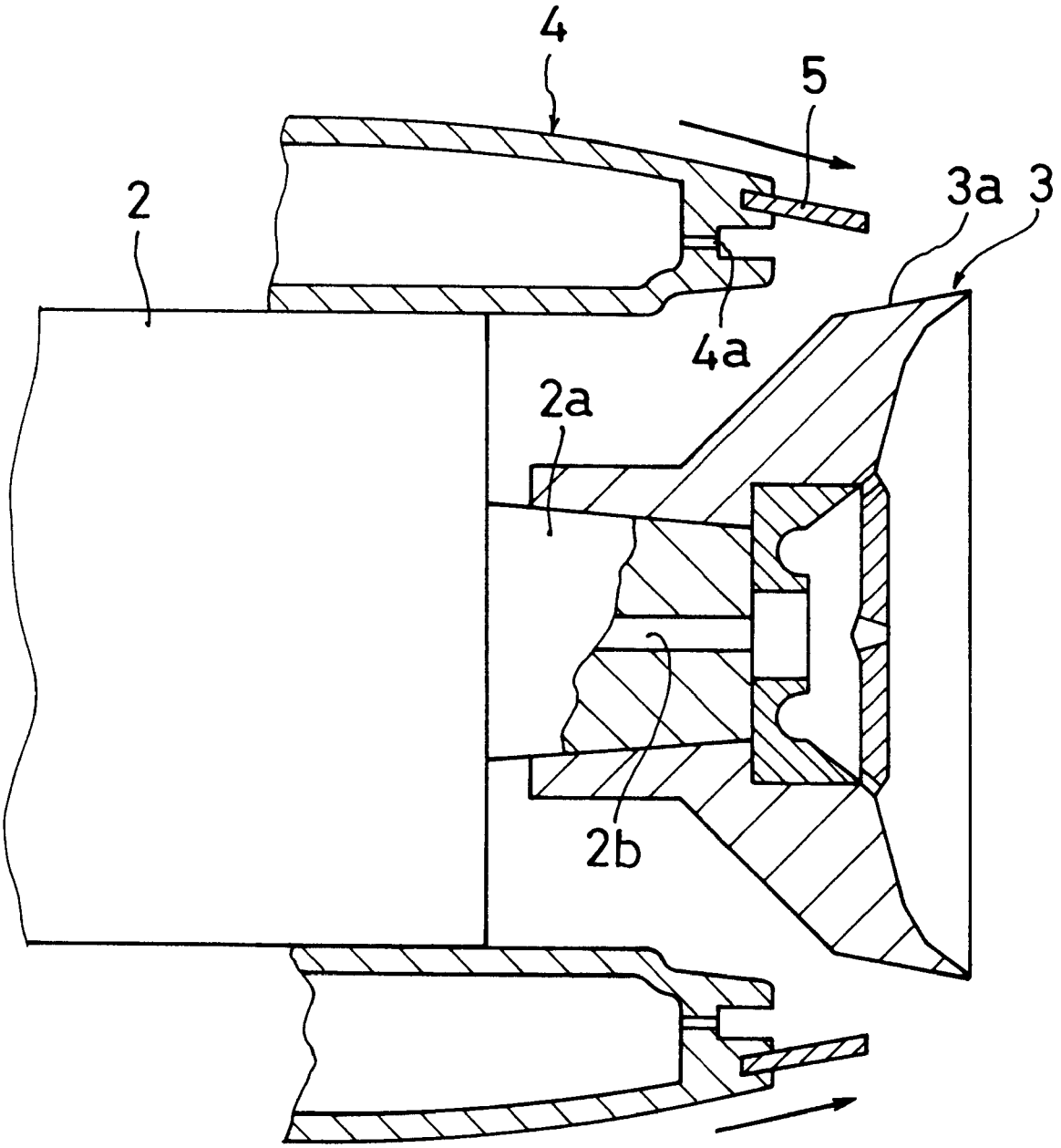
FIG. 3 is a sectional view of still another embodiment of the apparatus main body of the present invention.

As shown in FIG. 2, the following arrangement may also be employed. Namely, at the front end portion of the inner ring member 41, there is formed a bent portion which comes into contact with the front end surface of the outer ring member 42 to thereby form a jet nozzle 41*d* in the bent portion. The cylindrical member 5 which extends forward may be formed at the front end of the bent portion. As another alternative arrangement, as shown in FIG. 3, the shaping air ring 4 may be integrally formed, and the cylindrical member 5 which is separately formed may be attached thereto.

Figure 4:
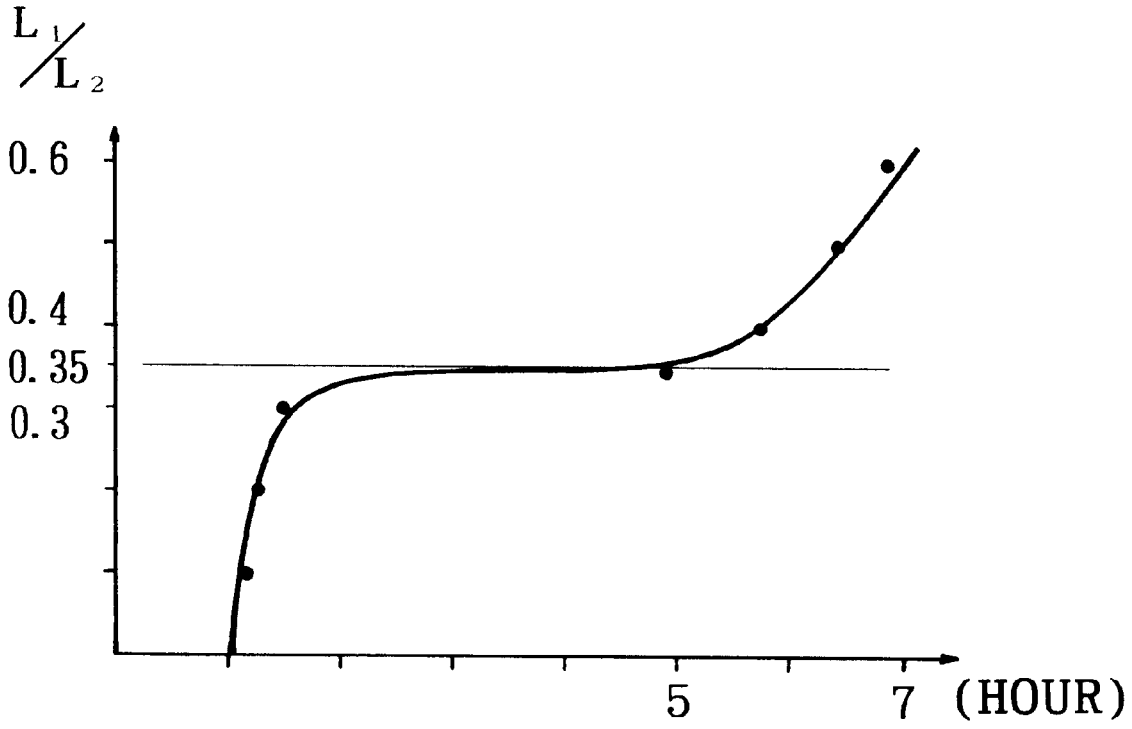
FIG. 4 is a graph to show the result of experiments about the effect of preventing the staining of the cylindrical member.

The graph shown in FIG. 4 shows the result of experiments which were performed to see the degree of stain on the outer peripheral surface 3*a* of the atomizing rotary head 3 when the cylindrical member 5 is attached to the front end of the outer ring member 42 of the shaping air ring 4. The ordinate of the graph represents the ratio between the axial distance L1 from the jet nozzle 41*d* of the shaping air ring 4 to the front end of the rotary atomizing head 3 and the axial distance L2 from the jet nozzle 41*d* to the front end of the cylindrical member 5 (L2/L1). The abscissa represents the time for the so-called spitting (or stains) to occur by the adhesion, to the surface of the object to be painted, of the foreign matters such as dust, paint, or the like which are peeled off from the stained portions of the outer peripheral surface 3*a* of the rotary atomizing head 3. The quicker is the progress of staining on the outer peripheral surface 3*a* of the rotary atomizing head 3, the shorter becomes the time for the spitting to occur on the surface of the object to be painted. Therefore, the time until the spitting to occur becomes an index to show the degree of staining on the outer peripheral surface 3*a* of the rotary atomizing head 3.

Figure 5:
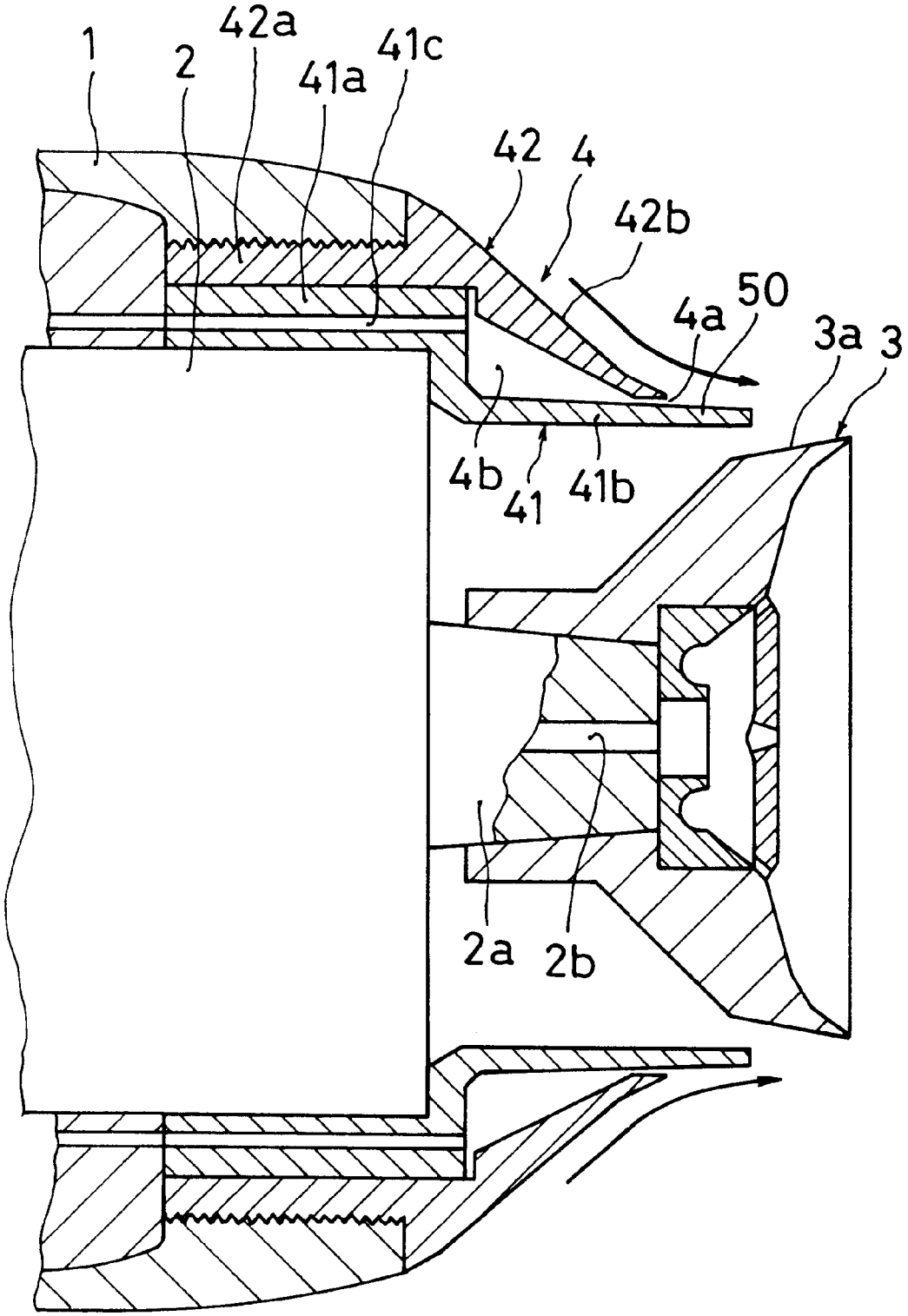
FIG. 5 is a sectional view of an embodiment for comparison purpose of the apparatus main body.
Figure 6:
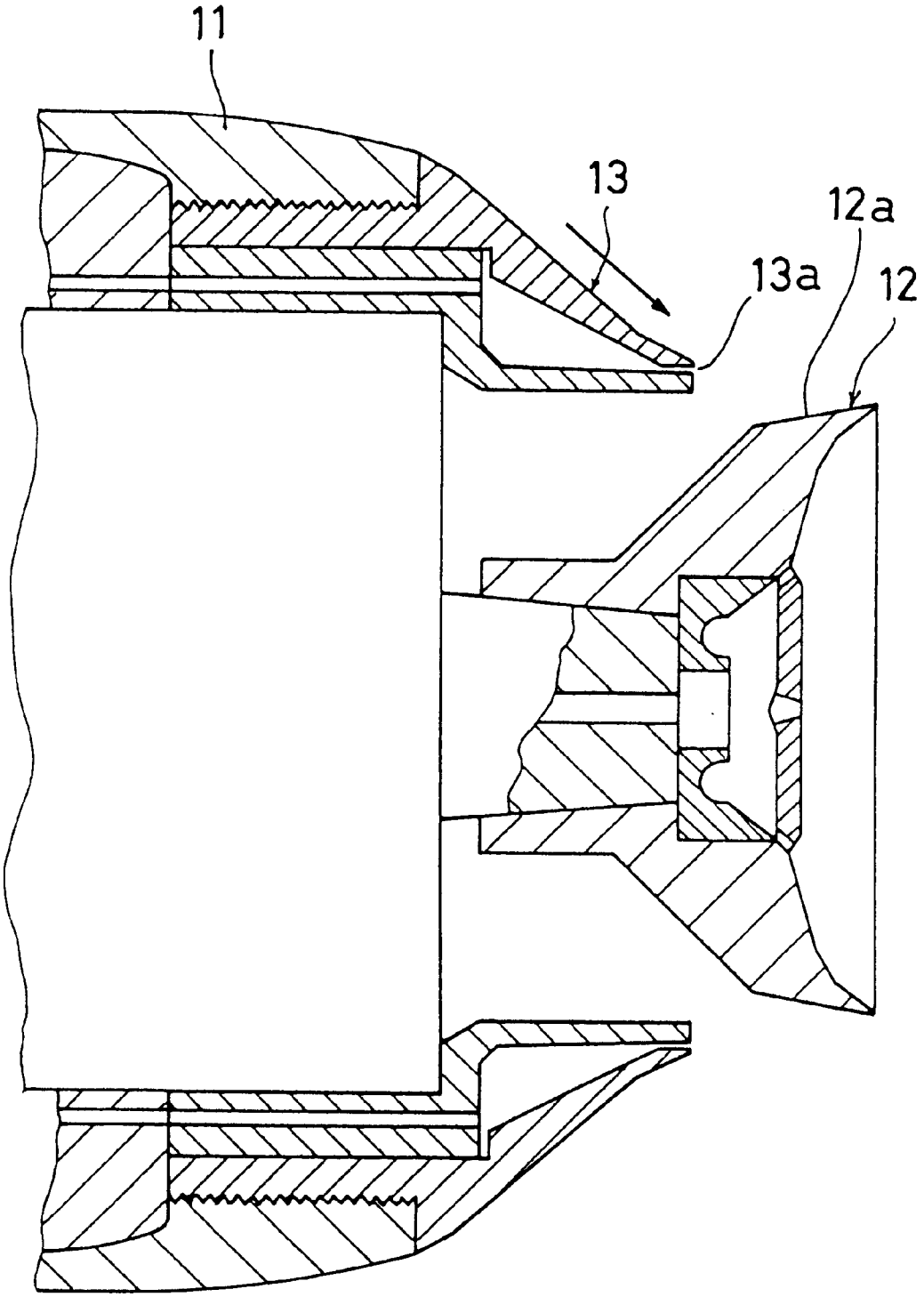
FIG. 6 PRIOR ART
FIG. 6 is a sectional view of a front end portion of the apparatus main body of a conventional rotary atomizing type of painting apparatus.

As can be seen from the graph, in the conventional apparatus (as in FIG. 6) in which there is no cylindrical member 5 (L2/L1=0), the spitting occurred about one hour after starting the painting work. On the other hand, if the cylindrical member 5 of 6 mm long (L2/L1=0.60), for example, was provided under the same conditions, the occurrence of the spitting was about seven hours after starting the painting work. The apparatus of the present invention can be seen effective. It has further been known that the cylindrical member 5 should preferably be dimensioned so that the above ratio (L2/L1) becomes 0.35 or more, most preferably 0.4 or more. In the apparatus in which, as shown in FIG. 5, at the front end of the inner ring member 41 of the shaping air ring 4 a cylindrical member 50 to partition the shaping air and the air inside thereof was formed, the spitting occurred about one hour after starting the painting. Therefore, there was little or no difference between the conventional apparatus.

As explained hereinabove, according to the present invention, the outer peripheral surface of the rotary atomizing head becomes hardly stained. Therefore, the interval between the maintenance works to be performed to prevent the occurrence of poor painting can be made longer and the productivity can be improved.

It is readily apparent that the above-described rotary atomizing type of painting apparatus meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A rotary atomizing type of painting apparatus comprising:

a rotary atomizing head; and a shaping air ring disposed to enclose a base portion of said rotary atomizing head such that shaping air is blown out of a jet nozzle formed in said shaping air ring toward a front end outer periphery of said rotary atomizing head;

characterized in that said shaping air ring is provided with a cylindrical member which partitions an air-flowing space in which the shaping air blown out of said jet nozzle flows and an outer space which is outside in a centrifugal direction of said rotary atomizing head relative to said air-flowing space, said cylindrical member having a cylindrical inner surface, an outer peripheral surface of said cylindrical member being formed such that an extended line of a generating line of said outer peripheral surface does not cross an outer peripheral surface of said rotary atomizing head.

2. A rotary atomizing type of painting apparatus according to claim 1, wherein a ratio L2/L1 is 0.35 or more where L1 is an axial distance from said jet nozzle to the front end of said rotary atomizing head and L2 is an axial distance from said jet nozzle to a front end of said cylindrical member.

* * * * *